US008858899B2

(12) United States Patent
Agren et al.

(10) Patent No.: US 8,858,899 B2
(45) Date of Patent: Oct. 14, 2014

(54) FRACTION COLLECTOR

(75) Inventors: Tomas Agren, Uppsala (SE); Johan Carlsson, Kungsangen (SE)

(73) Assignee: GE Healthcare Bio-Sciences AB, Uppsala (SE)

( * ) Notice: Subject to any disclaimer, the term of this patent is extended or adjusted under 35 U.S.C. 154(b) by 609 days.

(21) Appl. No.: 12/797,016

(22) Filed: Jun. 9, 2010

(65) Prior Publication Data

US 2011/0139303 A1 Jun. 16, 2011

(30) Foreign Application Priority Data

Jun. 10, 2009 (SE) ..... 0950435

(51) Int. Cl.
*B01L 3/00* (2006.01)
*B65B 3/00* (2006.01)

(52) U.S. Cl.
CPC ..... *B65B 3/003* (2013.01)
USPC ..... 422/552; 422/65; 422/502; 422/509; 141/270; 141/283; 141/1

(58) Field of Classification Search
CPC ..... B01L 2300/0829; B01J 2219/00313; B01J 2219/00315; B01J 2219/00317; B01J 2219/00319
USPC ..... 141/250–284, 1, 129, 130; 422/63, 65, 422/67, 502, 521, 552, 561, 68.1, 501, 509; 436/180
See application file for complete search history.

(56) References Cited

U.S. PATENT DOCUMENTS

| | | | | |
|---|---|---|---|---|
| 4,166,483 | A * | 9/1979 | Nordlund | 141/1 |
| 5,592,289 | A * | 1/1997 | Norris | 356/244 |
| 6,074,609 | A * | 6/2000 | Gavin et al. | 422/565 |
| 7,028,831 | B2 * | 4/2006 | Veiner | 198/619 |
| 7,159,740 | B2 * | 1/2007 | Nanthakumar et al. | 221/224 |
| 7,371,347 | B2 * | 5/2008 | Wulf et al. | 422/501 |
| 7,585,463 | B2 * | 9/2009 | Austin et al. | 422/63 |
| 7,682,565 | B2 * | 3/2010 | Linton et al. | 422/68.1 |
| 7,858,041 | B2 * | 12/2010 | Muraishi et al. | 422/511 |
| 8,029,745 | B2 * | 10/2011 | Hunter et al. | 422/515 |
| 8,034,194 | B2 * | 10/2011 | Ikushima | 134/166 R |
| 2004/0022689 | A1 * | 2/2004 | Wulf et al. | 422/100 |
| 2005/0244302 | A1 * | 11/2005 | Overbeck et al. | 422/100 |
| 2006/0002824 | A1 * | 1/2006 | Chang et al. | 422/100 |
| 2006/0029524 | A1 | 2/2006 | Carter et al. | |
| 2006/0266719 | A1 | 11/2006 | Knight et al. | |

FOREIGN PATENT DOCUMENTS

| | | |
|---|---|---|
| WO | WO 98/17391 | 4/1998 |
| WO | WO 2005/042146 | 5/2005 |
| WO | WO 2007088921 A1 * | 8/2007 |

* cited by examiner

*Primary Examiner* — Timothy L Maust

(57) ABSTRACT

A fraction collector where fractions of liquid are sequentially dispensed from a dispensing means into a plurality of receptacles arranged in a cassette in the fraction collector, by displacing the dispensing means relative to the receptacles, the receptacles being arranged at predefined positions with respect to the cassette and the cassette being arranged at a predetermined position with respect to the fraction collector, wherein the cassette is retained at the predefined position with respect to the fraction collector by a magnetic arrangement.

3 Claims, 4 Drawing Sheets

FRACTION COLLECTOR

CROSS-REFERENCE TO RELATED APPLICATIONS

This application claims priority to Swedish patent application number 0950435-8 filed Jun. 10, 2009; the disclosure of which is incorporated herein by reference in its entirety.

FIELD OF THE INVENTION

The present invention pertains to the field of fraction collectors, particularly to fraction collectors where the receptacles are arranged in cassettes.

BACKGROUND OF THE INVENTION

A fraction collector is a device used for dispensing a flow of liquid in a number of receptacles where the receptacles are fed towards a dispensing means by means of a relative movement in one or two directions. As the droplets dispensed can have a diameter of 4 millimeters and the smallest receptacles have an orifice of 6.7 millimeters it is important that the receptacles are held in exactly the right position to avoid spilling. In a fraction collector used e.g. in an HPLC (High Pressure Liquid Chromatography) system it is important that different types of receptacles can be used. Thus the receptacles can consist e.g. of test tubes of various sizes or micro titer plates. This flexibility can be achieved by using a cassette tray onto which various types of cassettes for various types of receptacles can be loaded. The various types of cassettes are provided with some type of identification means so that the fraction collector can read e.g. the size of the test tubes and make the correct positioning of the dispensing means.

However, taking into account the small dimensions it is of great importance that said cassettes are positioned with very high accuracy, but at the same time the positioning of the cassettes in the fraction collector must be user friendly and not impose any additional action to ensure proper alignment.

SUMMARY OF THE INVENTION

The object of the invention is to provide a new fraction collector, fraction collector tray and fraction collector cassette, which overcomes one or more drawbacks of the prior art. This is achieved by the fraction collector, fraction collector tray and fraction collector cassette as defined in the independent claims.

One advantage with such a fraction collector is that proper alignment is achieved without any additional action to ensure proper alignment.

Further scope and applicability of the present invention will become apparent from the detailed description given hereinafter. However it should be understood that a detailed description and specific examples while indicating preferred embodiments of the invention are given by illustrations only. There are changes and modifications in the spirit and scope of the invention which will become apparent to those skilled in the art from the detailed description below.

DETAILED DESCRIPTION OF THE INVENTION

According to one embodiment, there is provided a fraction collector where fractions of liquid are sequentially dispensed from a dispensing means into a plurality of receptacles arranged in a cassette in the fraction collector, by displacing the dispensing means relative to said receptacles, said receptacles being arranged at predefined positions with respect to the cassette and said cassette being arranged at a predetermined position with respect to the fraction collector, characterized in, that the cassette is retained at said predefined position with respect to the fraction collector by a magnetic arrangement According to one embodiment, the magnetic arrangement is arranged to pull the cassette against mechanical positioning means of the fraction collector.

Figure 1:
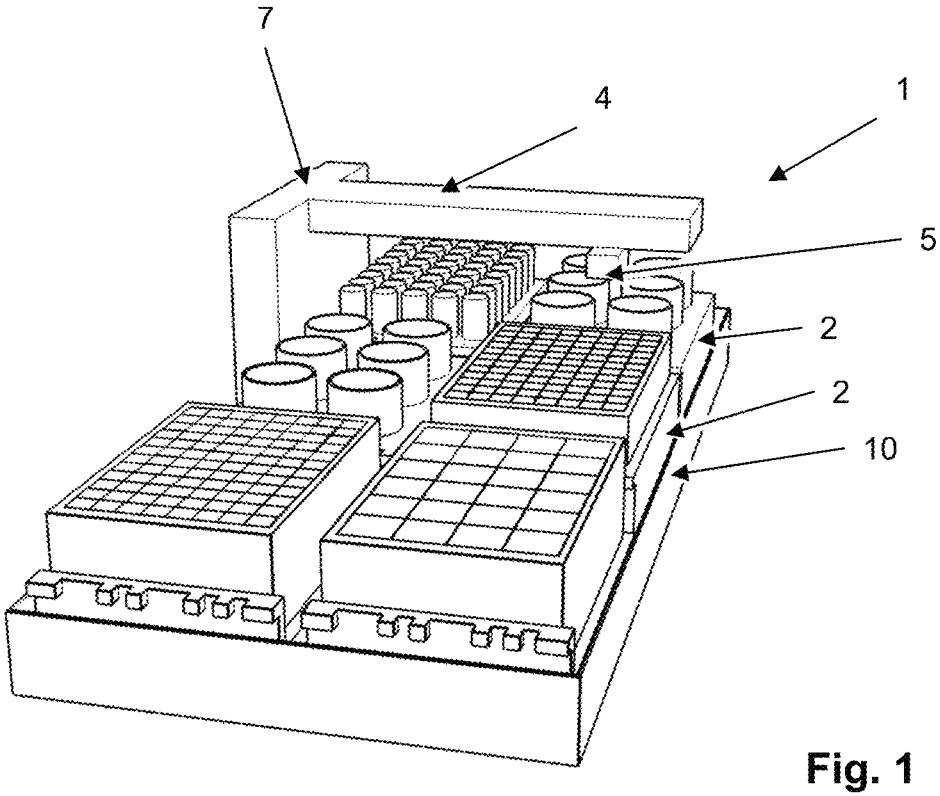
FIG. 1 is a perspective view of a fraction collector in which the method according to the invention is applied.

FIG. 1 shows a schematic perspective view of a fraction collector 1. In FIG. 1, reference number 10 denotes a cassette tray onto which are loaded a number of cassettes 2 of different types depending on the type of receptacles they are to hold. Thus reference number 2 denotes both cassettes for holding micro titer plates and cassettes for holding test tubes of different dimensions. The fraction collector is further provided with an arm 4 held by a holder 7 movable in the y-direction. On the arm 4 is arranged a sensing and dispensing head 5 movable in the x-direction. Thus the dispensing head can be moved across all cassettes on the cassette tray to dispense liquid fractions into said receptacles.

Figure 2:
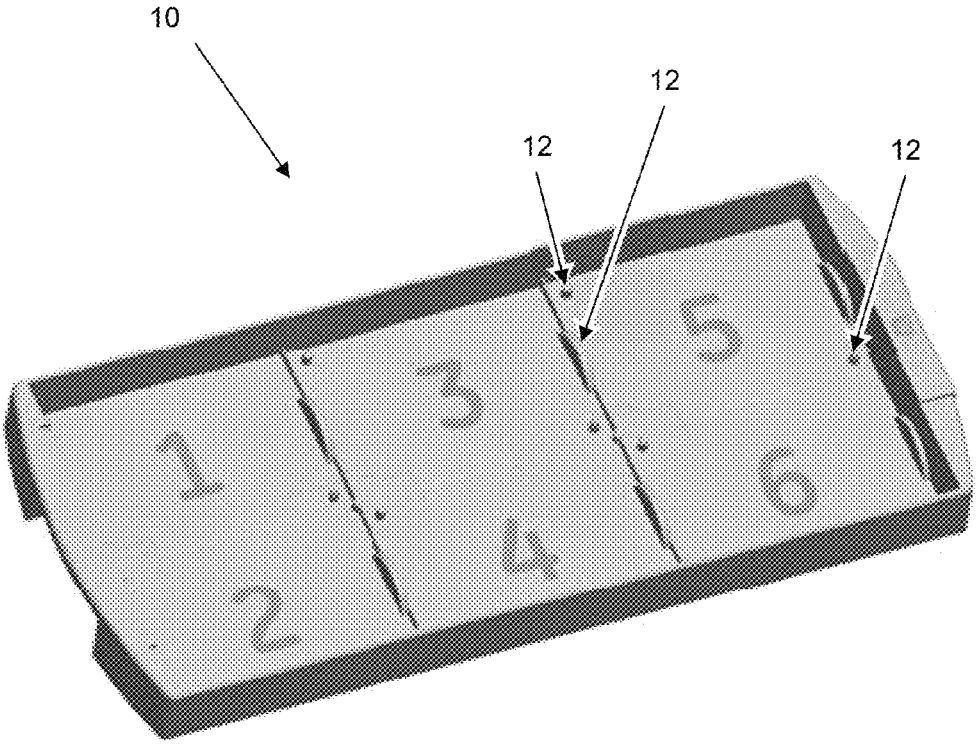
FIG. 2 is a perspective view of a cassette tray used in the fraction collector of FIG. 1.

FIG. 2 shows a perspective view of a cassette tray 10 for a fraction collector as shown in FIG. 1. The disclosed tray comprises predefined 6 cassette positions, and there are shown cassette positioning means 12 of different types. According to one embodiment, disclosed in detail in the co-pending patent application PCT/SE2009/05041 different cassettes are provided with bar codes which are different for different types of cassettes. The cassette tray has six cassette positions. The cassettes are held in position on the cassette tray by magnets. The cassette type codes of the cassettes are used by the cassette code reader during scanning to determine the type of cassette. The illustration below shows cassettes placed on a cassette tray.

Figure 3A:
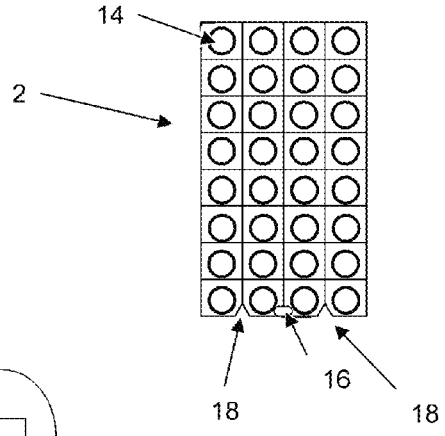
FIG. 3*a* and FIG. 3*b* schematically illustrates magnetic positioning of cassettes with respect to the tray.

FIG. 3*a* is a schematic top view of a cassette 2 with a plurality (32) of receptacles 14. The cassette comprises an iron bar 16 (or of another suitable magnetic material) for proper alignment of the cassette with respect to the tray 10. The cassette further comprises mechanical positioning means 18 schematically shown as two V grooves in one edge of the cassette. As disclosed above the mechanical positioning means may be of any suitable form as long as they provide accurate positioning of the cassette with respect to the tray, when pulled in a predetermined direction by the magnetic positioning arrangement.

Figure 3B:
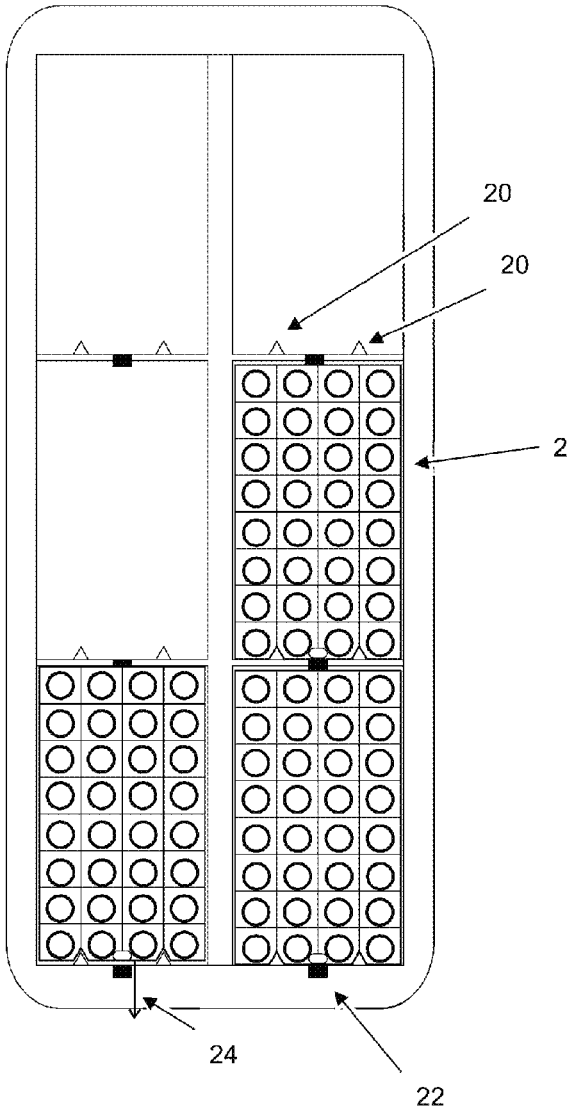

FIG. 3*b* schematically illustrates a tray 10 with six cassette positions of mating type with the cassette 2 of FIG. 3*a*. In the tray 10 each cassette position comprises two mating mechanical positioning means 20 in the form of V protrusions for alignment of the cassette and a magnet bar 22 arranged to attract the iron bar 16 in the cassette. Alternatively the magnet 22 may be arranged in the cassette and the iron bar 16 in the tray. According to one embodiment, the magnet 22 is a permanent magnet, but in alternatively, it may be an electromagnet, that can be turned on when alignment is essential, but also be turned off in order to facilitate removal of cassettes from the tray. In FIG. 3*b* the arrow 24 indicated the force applied on the cassette by the magnetic alignment arrangement. The magnetic force pulls the cassette against the mating mechanical positioning means 20. Hence, the surface finish of the tray and the bottom of the cassette should be selected to avoid excessive friction that may delay or hinder proper alignment.

Figure 4:
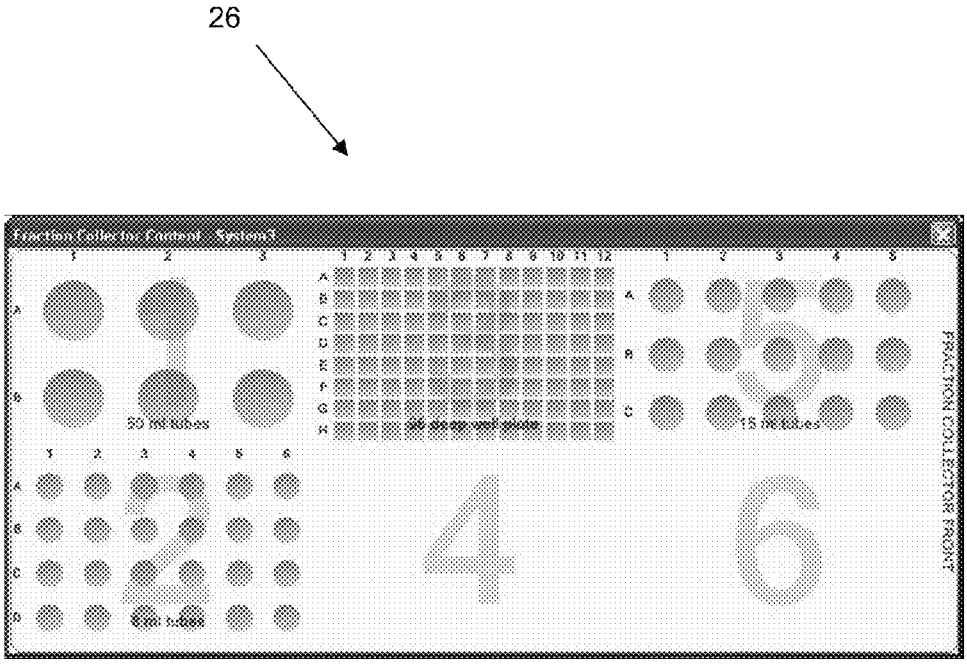
FIG. 4 shows a graphic illustration of cassettes arranged in a tray according to the system controller interface.

As mentioned briefly above, sensing and dispensing head 5 is arranged to identify the type of cassette placed in each cassette position on the tray, but it is not arranged to detect the alignment of the individual cassettes. Hence the performance of the fraction collector is strongly dependent on proper alignment of cassettes with respect to the fraction collector. When the fraction collector has identified the cassettes it creates a virtual image of the positions of the receptacles assuming that all cassettes are in proper alignment, FIG. 4 shows a graphic illustration 26 of cassettes arranged in a tray according to the system controller interface.

It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

What is claimed is:

1. A fraction collector arrangement comprising a fraction collector arm (4) and dispensing head (5) on said arm; a cassette tray (10); and at least one cassette (2); said cassette tray including plural predefined cassette holding positions; wherein said at least one cassette includes a plurality of receptacles, said receptacles being arranged at predefined positions in said at least one cassette and the at least one cassette being selectively positionable at one of a plurality of selectable positions with respect to said tray, wherein said cassette and the cassette tray each include complementary magnetic arrangements and mechanical positioners, whereby said cassette is retained at said one selectable position with respect to the tray by said complementary magnetic arrangement and wherein fractions of liquid are sequentially dispensed from said dispensing head into the plurality of receptacles arranged in said cassette, by movement of the dispensing head on the arm and wherein the complementary magnetic arrangement pulls said cassette against said mechanical positioners when said cassette is positioned on the tray.

2. A liquid fraction collection method comprising the following steps:

i) providing a fraction collector including a cassette tray (10) and a dispensing head (5) movable relative to the tray;

ii) providing a plurality of cassettes selectively positionable on the tray by means of complementary mechanical positioners and magnetic arrangements between the tray and each cassette, each cassette including receptacles for accepting liquid dispensed by the dispensing head;

iii) positioning said plurality of cassettes on the tray, by means of both said mechanical positioners and said magnetic arrangements wherein the complementary magnetic arrangement pulls said cassette against respective mechanical positioners when said cassette is positioned on the tray; and iv) sequentially dispensing fractions of liquid from a dispensing head into said receptacles.

3. The liquid fraction collection method of claim 2, further including the step of allowing the head to identify the selected cassette in order to perform said sequential dispensing step correctly.

* * * * *